US011992090B2

(12) United States Patent
DeWillie et al.

(10) Patent No.: US 11,992,090 B2
(45) Date of Patent: May 28, 2024

(54) KNITTED COMPONENTS HAVING SELF SUPPORTIVE HEEL

(71) Applicant: NIKE, Inc., Beaverton, OR (US)

(72) Inventors: Kevin S. DeWillie, Portland, OR (US); Scott R. Kamrowski, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 345 days.

(21) Appl. No.: 16/053,026

(22) Filed: Aug. 2, 2018

(65) Prior Publication Data

US 2019/0037968 A1 Feb. 7, 2019

Related U.S. Application Data

(60) Provisional application No. 62/542,016, filed on Aug. 7, 2017.

(51) Int. Cl.
*A43B 23/02* (2006.01)
*A43B 1/04* (2022.01)
(Continued)

(52) U.S. Cl.
CPC ..... *A43B 23/027* (2013.01); *A43B 1/04* (2013.01); *A43B 1/14* (2013.01); *A43B 21/20* (2013.01);
(Continued)

(58) Field of Classification Search
CPC ..... A43B 23/027; A43B 23/0215; A43B 23/0245; A43B 23/025; A43B 23/0265;
(Continued)

(56) References Cited

U.S. PATENT DOCUMENTS 1,544,934 A * 7/1925 Prankard ..... A41B 11/00 66/188
1,936,038 A * 11/1933 Schindler ..... D04B 1/104 66/185
(Continued)

FOREIGN PATENT DOCUMENTS

CN 101460072 A 6/2009
CN 101583294 A 11/2009
(Continued)

OTHER PUBLICATIONS

PCT International Search Report and Written Opinion dated Nov. 14, 2018, for PCT Application No. PCT/US2018/045 392, (17 pp.).
(Continued)

*Primary Examiner* — Timothy K Trieu
*Assistant Examiner* — Dakota Marin
(74) *Attorney, Agent, or Firm* — Shook, Hardy & Bacon L.L.P.

(57) ABSTRACT

In one aspect of the disclosure, a knitted component may have a medial part, a lateral part, a forefoot region, a midfoot region, and a rearfoot region. The rearfoot region may include a first zone having a first level of stretch and extending from a lower region of one of the medial part and the lateral part toward an upper heel region. The first zone may have an elongate portion. The knitted component may include a second zone adjacent the first zone and having a second level of stretch greater than the first level of stretch. The second zone may extend into the medial part and the lateral part and may substantially cover a calcaneus region.

19 Claims, 10 Drawing Sheets

(51) Int. Cl.

| | |
|---|---|
| ***A43B 1/14*** | (2006.01) |
| ***A43B 21/20*** | (2006.01) |
| ***A43B 21/32*** | (2006.01) |
| ***A43B 23/04*** | (2006.01) |
| ***A43C 1/02*** | (2006.01) |
| ***D04B 1/24*** | (2006.01) |
| ***D04B 21/20*** | (2006.01) |

(52) U.S. Cl.
CPC ..... *A43B 21/32* (2013.01); *A43B 23/0215* (2013.01); *A43B 23/0245* (2013.01); *A43B 23/025* (2013.01); *A43B 23/0265* (2013.01); *A43B 23/0295* (2013.01); *A43B 23/042* (2013.01); *A43B 23/045* (2013.01); *A43C 1/02* (2013.01); *D04B 1/24* (2013.01); *D04B 21/207* (2013.01); *D10B 2401/041* (2013.01); *D10B 2401/061* (2013.01); *D10B 2501/043* (2013.01)

(58) Field of Classification Search
CPC . A43B 23/0295; A43B 23/042; A43B 23/045; A43B 1/04; A43B 1/14; A43B 21/20; A43B 21/32; A43C 1/02; D10B 2401/061; D10B 2401/041; D10B 2501/043; D10B 21/207; D10B 1/24
USPC ..... 36/87
See application file for complete search history.

(56) References Cited

U.S. PATENT DOCUMENTS

| | | | | | |
|---|---|---|---|---|---|
| 2,050,535 | A * | 8/1936 | Martel | D04B 1/18 | 66/178 R |
| 4,559,722 | A * | 12/1985 | Norton | A43B 5/06 | 36/105 |
| 4,898,007 | A * | 2/1990 | Dahlgren | A41B 11/003 | 2/239 |
| 5,103,656 | A * | 4/1992 | Hanson, II | A41B 11/003 | 2/239 |
| 5,603,232 | A * | 2/1997 | Throneburg | A41B 11/02 | 2/239 |
| 5,617,745 | A * | 4/1997 | Della Corte | A41B 11/003 | 2/239 |
| 5,771,495 | A * | 6/1998 | Turner | A41B 11/00 | 2/239 |
| 6,557,274 | B2 * | 5/2003 | Litchfield | A43B 13/203 | 36/71 |
| 6,708,348 | B1 * | 3/2004 | Romay | D04B 1/26 | 2/239 |
| 6,910,288 | B2 * | 6/2005 | Dua | A43B 1/04 | 36/45 |
| 6,931,762 | B1 * | 8/2005 | Dua | A43B 1/04 | 12/142 G |
| 7,743,531 | B2 * | 6/2010 | Aveni | A43B 23/024 | 36/105 |
| 8,578,632 | B2 * | 11/2013 | Bell | A43C 1/04 | 36/88 |
| 9,095,186 | B2 * | 8/2015 | Follet | A43B 23/0245 | |
| 9,192,204 | B1 * | 11/2015 | Liles | A43C 1/04 | |
| 9,351,532 | B2 * | 5/2016 | Mokos | A43B 23/0205 | |
| 9,572,395 | B2 * | 2/2017 | Roser | A43B 5/002 | |
| 9,635,905 | B2 * | 5/2017 | Dekovic | A43B 23/0255 | |
| 9,907,349 | B2 * | 3/2018 | Huffman | A43B 23/0245 | |
| 9,968,156 | B2 * | 5/2018 | Huffman | A43B 23/042 | |
| 10,863,794 | B2 * | 12/2020 | Bruce | A43B 23/0235 | |
| 11,044,963 | B2 * | 6/2021 | Love | A43B 5/02 | |
| 11,214,897 | B2 * | 1/2022 | Berrian | A43B 1/04 | |
| 2004/0261466 | A1 * | 12/2004 | Takeda | D04B 1/108 | 66/176 |
| 2006/0218973 | A1 * | 10/2006 | Kim | D04B 1/26 | 66/178 R |
| 2008/0000106 | A1 * | 1/2008 | Culpepper | A43B 23/17 | 36/89 |
| 2008/0028640 | A1 * | 2/2008 | Lacorazza | A43B 3/26 | 36/97 |
| 2008/0041113 | A1 * | 2/2008 | Mori | A41B 11/02 | 66/54 |
| 2009/0223254 | A1 * | 9/2009 | Ishida | D04B 1/02 | 66/185 |
| 2009/0282607 | A1 * | 11/2009 | Kaneda | A41B 11/02 | 2/239 |
| 2009/0288451 | A1 * | 11/2009 | Yokoyama | D04B 1/26 | 66/185 |
| 2013/0312284 | A1 * | 11/2013 | Berend | A43B 1/0072 | 36/84 |
| 2014/0150292 | A1 * | 6/2014 | Podhajny | A43B 23/0205 | 36/50.1 |
| 2014/0373389 | A1 * | 12/2014 | Bruce | A43B 23/042 | 36/87 |
| 2015/0047225 | A1 * | 2/2015 | Zavala | A43C 11/006 | 36/84 |
| 2015/0143716 | A1 * | 5/2015 | Long | A43B 23/0235 | 36/83 |
| 2015/0216253 | A1 * | 8/2015 | Podhajny | D04B 1/12 | 28/165 |
| 2017/0238658 | A1 * | 8/2017 | Gu | A43B 23/08 | |
| 2017/0332722 | A1 * | 11/2017 | Dealey | A43B 1/04 | |
| 2018/0325215 | A1 * | 11/2018 | T Stensen | A43B 13/04 | |

FOREIGN PATENT DOCUMENTS

| | | |
|---|---|---|
| CN | 201480129 U | 5/2010 |
| CN | 103582433 A | 2/2014 |
| CN | 104413996 A | 3/2015 |
| CN | 204796865 U | 11/2015 |
| CN | 205813720 U | 12/2016 |
| CN | 206043576 U | 3/2017 |
| CN | 106604656 A | 4/2017 |
| CN | 107920629 A | 4/2018 |
| EP | 3 045 067 | 7/2016 |
| WO | WO 2015/183350 | 12/2015 |

OTHER PUBLICATIONS

Office Action received for European Patent Application No. 18759212.6, dated Mar. 22, 2023, 5 pages.

* cited by examiner

KNITTED COMPONENTS HAVING SELF SUPPORTIVE HEEL

CROSS-REFERENCE TO RELATED APPLICATION

This application claims benefit to U.S. Provisional Patent Application No. 62/542,016, filed on Aug. 7, 2017, the entirety of which is hereby incorporated by reference herein.

BACKGROUND

The present embodiments relate generally to knitted components and methods of manufacturing knitted components, and more particularly, to knitted components for use in footwear applications.

Articles of footwear conventionally include an upper and optionally a sole structure. The upper may be secured to the sole structure and form a void on the interior of the footwear for comfortably and securely receiving a foot. The sole structure may be secured to a lower surface of the upper so as to be positioned between the upper and the ground.

Various materials are conventionally used in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. Some uppers may be formed from a knitted material. Incorporating knitted components into an upper, or knitting an upper, may provide advantages over conventionally manufactured uppers, for example based on properties of the knit due to structure, configuration, or materials.

Conventional articles of footwear include rigid structure over a region corresponding to the calcaneus of a wearer's foot. For example, conventional articles of footwear typically include a heel counter, i.e., a supportive panel that extends around the heel to provide support and control. A conventional heel counter may be constructed of a relatively stiff or rigid material, for example, plastic or leather, and may extend around the heel area of the foot, and generally forwardly of the calcaneus on both sides of the foot. While heel counters and similar rigid structures may enhance stability and control, they may contribute to any of increased weight, cost, and manufacturing complexity, and may reduce the flexibility of the article of footwear.

SUMMARY

In one aspect of the disclosure, a knitted component may have a medial part, a lateral part, a forefoot region, a midfoot region, and a rearfoot region. The rearfoot region may include a first zone having a first level of stretch and may extend from a lower region of one of the medial part and the lateral part toward an upper heel region. The first zone may have an elongate portion. The knitted component may include a second zone adjacent the first zone and having a second level of stretch greater than the first level of stretch. The second zone may extend into the medial part and the lateral part and may substantially cover a calcaneus region. In another aspect, the knitted component may include a third zone having a stretch property that may extend from a lower region of one other of the lateral side toward the upper heel region. The third zone may have an elongate portion. In another aspect, the first zone may include a thermoplastic yarn. In another aspect, the second zone may include a different knit stitch than the first zone. In another aspect, at least one of the first zone and the second zone may be formed on at least two needle beds of a knitting machine. In another aspect, the knitted component may include an overfoot portion joined with an underfoot portion around a perimeter. In another aspect, the elongate portion of the first zone may include at least one of an elliptical shape, a rectangular shape, a triangular shape, a finger shape, or a tapered shape. In another aspect, at least one of the first zone and the second zone may include a plurality of apertures. In another aspect, the first zone may be continuous with the third zone in the upper heel region. In another aspect, the first zone may bound at least ten percent of a border length of the second zone.

In another aspect of the disclosure, an article of footwear may include an upper having a medial side, a lateral side, a forefoot region, a midfoot region, and a rearfoot region. The rearfoot region may include a knitted component. The knitted component may include a first zone with a first level of stretch and may include an elongate portion extending from a lower region of one of the medial side and the lateral side toward an upper heel region. The knitted component may include a second zone with a second level of stretch that is greater than the first level of stretch. The second zone may extend from the medial side to the lateral side, may substantially cover a calcaneus region, and may at least partially surround the second zone. In another aspect, the article of footwear may include a third zone with a stretch property and an may include elongate portion extending from a lower region of one other of the medial side and lateral side toward the upper heel region. In another aspect, the rearfoot region may be substantially free from rigid structure separate from the knitted component. In another aspect, the first zone and the third zone may be continuous in the upper heel region. In another aspect, the first zone may pull the second zone toward the forefoot region. In another aspect, the first zone may form a connection with a closure system. In another aspect, the closure system may include a tensile strand in a collar region. In another aspect, the closure system may create a tension force in the first zone. In another aspect, the closure system may draw the second zone toward the forefoot region.

In another aspect of the disclosure, a method of forming a rearfoot region of a knitted component may include forming an elongate portion of a first zone of knit stitches, where the first zone may have a first level of stretch and may extend from a lower region of one of a medial or a lateral side toward an upper heel region. The method may also include forming a second zone of knit stitches either before or after forming the elongate portion of the first zone. The second zone may be adjacent the first zone, may substantially cover a calcaneus region, and may have a second level of stretch greater than the first level of stretch. The first zone may at least partially surround the second zone.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
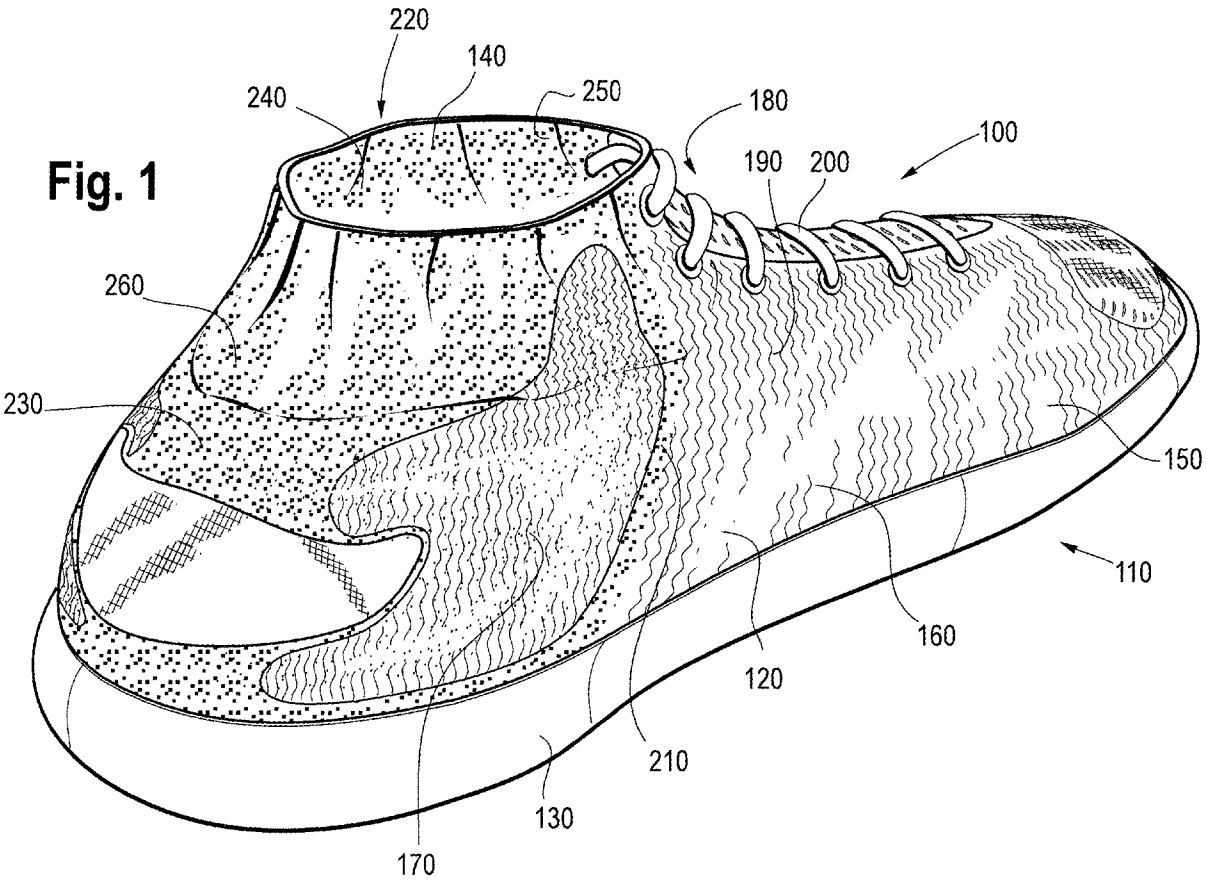
FIG. 1 is a rear isometric view of an article of footwear incorporating a knit upper.
Figure 2:
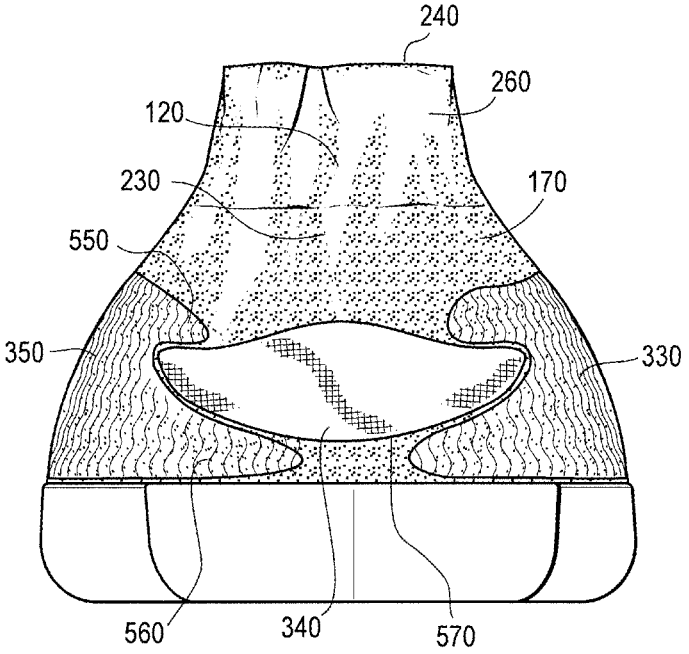
FIG. 2 is a rear view of the article of footwear of FIG. 1.

FIGS. 1-2 illustrate an article of footwear 100 formed with an upper 110 that includes a knitted component 120. As shown, the upper 110 may be secured to at least one sole structure 130. Article 100 is disclosed as having a general configuration suitable for walking, running, athletics, and other ambulatory activities. Concepts associated with the footwear, including the upper 110 and knitted component 120, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. Furthermore, the concepts disclosed herein may apply to articles beyond footwear, such as accessories or apparel.

As shown in FIGS. 1-2, the upper 110 may generally provide a comfortable and secure covering for a foot of a wearer. As such, the wearer may insert a foot into a void 140 formed by the upper 110 to effectively secure the foot within article 100 or otherwise unite the foot and article 100. Moreover, sole structure 130 may be secured to a lower area of the upper 110 and extend between the foot and the ground to attenuate ground reaction forces (i.e., cushion the foot), provide traction, enhance stability, and influence the motions of the foot.

For reference purposes, article may be divided generally along a longitudinal axis (heel-to-toe) into three general regions: a forefoot region 150, a midfoot region 160, and a rearfoot region 170. Forefoot region 150 generally includes portions of article 100 corresponding with the toes and the joints connecting the metatarsals with the phalanges. Midfoot region 160 generally includes portions of article 100 corresponding with an arch area of the foot. Rearfoot region 170 generally corresponds with rear portions of the foot, including areas that cover the calcaneus bone (which comprises a portion of a wearer's heel). Additionally, the rearfoot region 170 may cover some or all of the wearer's malleoli and talus (which comprise a portion of the ankle), and may extend forward of those areas. Article 100 also includes a lateral side 180 and a medial side 190, which extend through each of forefoot region 150, midfoot region 160, and rearfoot region 170 and correspond with opposite sides of article 100. More particularly, lateral side 180 corresponds with an outside area of the foot (i.e., the surface that faces away from the other foot), and medial side 190 corresponds with an inside area of the foot (i.e., the surface that faces toward the other foot). Forefoot region 150, midfoot region 160, and rearfoot region 170 and lateral side 180, medial side 190 are not intended to demarcate precise areas of article 100. Rather, they are intended to represent general areas of article 100 to aid in the following discussion.

Referring still to FIGS. 1-2, the rearfoot region 170 may secure the wearer's heel within the article 100 and may also protect the wearer's heel from abrasion and shock. The rearfoot region 170 of the article 100 may include components of the upper 110 (including knitted component 120) and the sole structure 130, and may additionally interact with other systems within the article (e.g., a closure system 200) to improve functionality and performance. Notably, rearfoot region 170 need not be visually distinct from midfoot region 160 of article 100 (for example, distinguished by an edge). Rather, the two regions may continuously transition, as through a common and continuous knit structure formed during a single knitting process.

Figure 3:
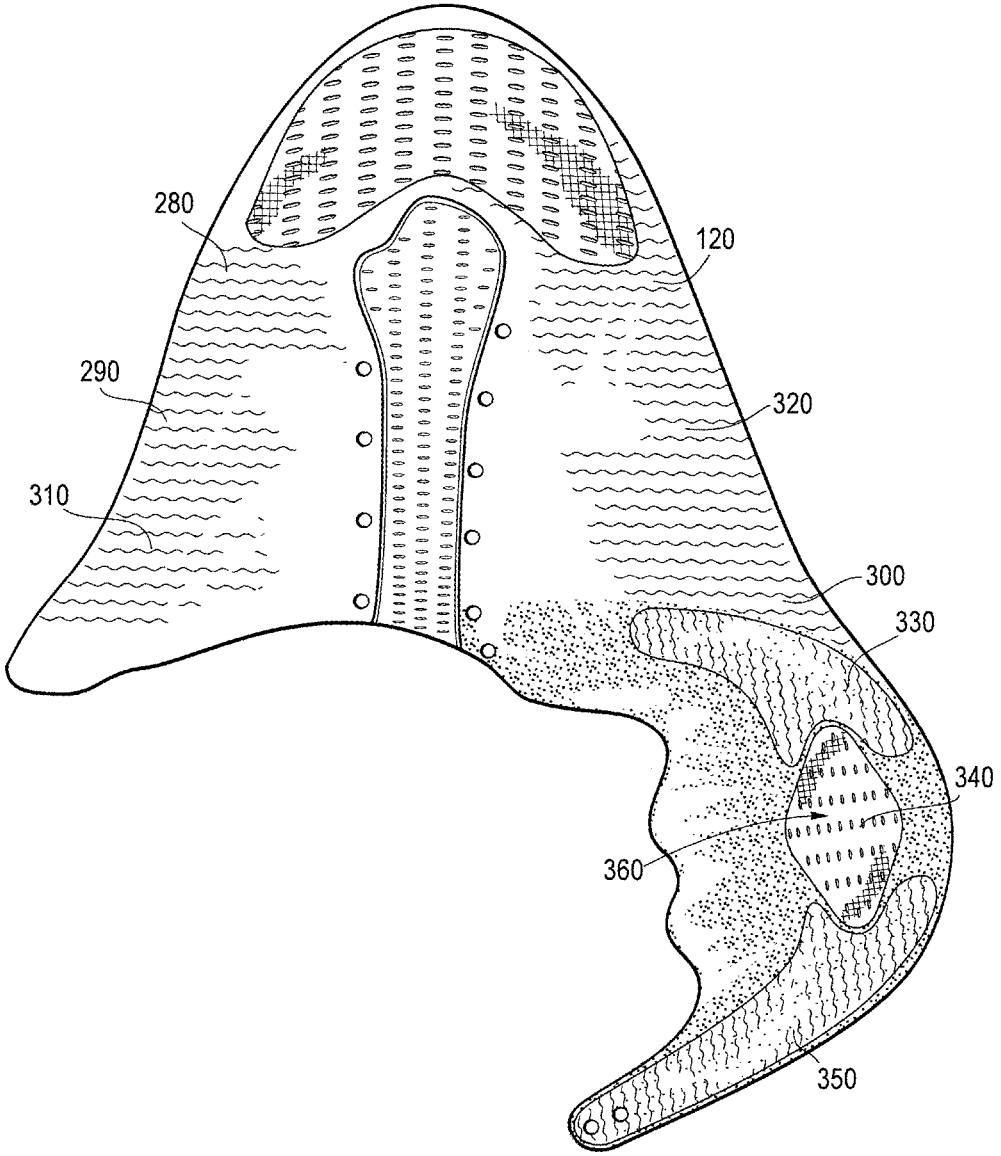
FIG. 3 is an embodiment of a knit component that may be used to form a knit upper.
Figure 4:
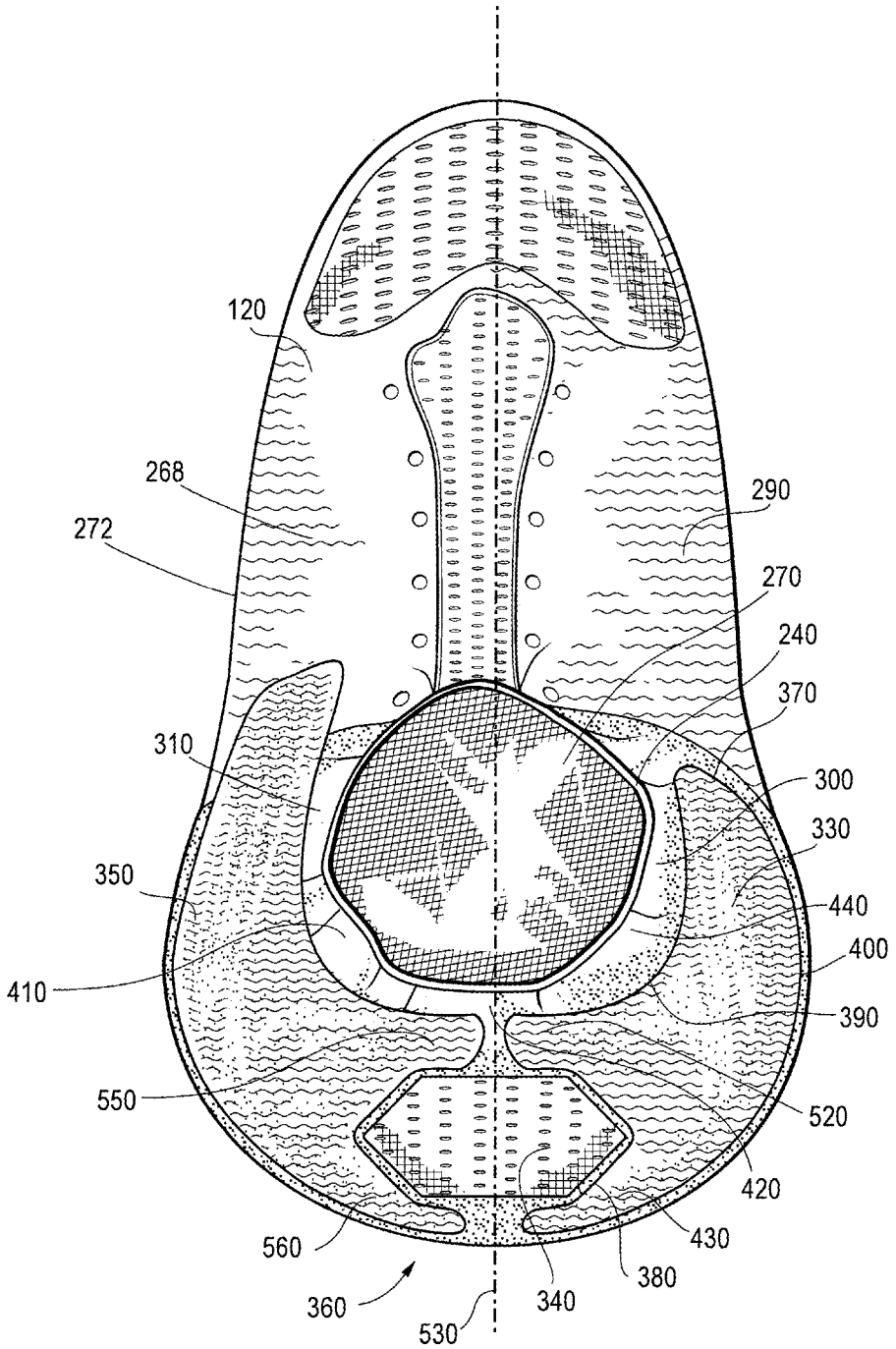
FIG. 4 is another embodiment of a knit component that may be used to form a knit upper.

Referring still to FIGS. 1-2, the midfoot region 160 may transition to the rearfoot region 170 at a medial border region 210 and a lateral border region 220, which may include different knit structures relative to either or both of the medial and rearfoot regions 160, 170, such as a transitional knit structure. Alternatively, the medial and lateral border regions 210, 220 may include knit structures substantially similar or identical to the midfoot and rearfoot regions 160, 170. The transition from the midfoot region 160 to the rearfoot region 170 in the medial and lateral border regions 210, 220 may be a continuous transition, such as in the case of an article of footwear having a knitted upper knitted in three dimensions (e.g., as shown in FIG. 4), or in the case of an article of footwear having a knitted upper knitted in two dimensions (e.g., as shown in FIG. 3) with edges in locations other than the medial or lateral border regions 210, 220. Alternatively, the medial and lateral border regions 210, 220 may include a post-knitting connection structure, such as a seam connecting edges of a knitted component.

Referring still to FIGS. 1-2, the rearfoot region 170 may extend from the medial border region 210, around a heel portion 230, to the lateral border region 220. Additionally, the rearfoot region 170 may extend upward to an opening 240 for receiving a wearer's foot, and from there may extend downward to the ground, encompassing all structure present in that space, such as a portion of the sole structure 130 designed to support a wearer's heel. Additionally, the rearfoot region 170 of the article 100 may include more than one layer of material, for example an interior knit layer 250 of the knitted component 120 positioned within the void 140 and intended to contact a wearer's foot, and an exterior knit layer 260 of the knitted component 120 facing outward from the void. In such cases, the layers may, but need not be, physically separable. The rearfoot region 170 may further include other components, such as components positioned between knit layers of an upper to provide cushioning.

Referring still to FIGS. 1-2, at least a portion of upper 110, and potentially substantially the entirety of upper 110, may be formed of the knitted component 120 (or another suitable textile component). The knitted component 120 may be formed as an integral one-piece element during a knitting process, such as a weft knitting process (e.g., with a flat knitting machine with one, two, or more needle beds, or with a circular knitting machine), a warp knitting process, or any other suitable knitting process. That is, the knitting process on the knitting machine may substantially form the knit structure of the knitted component 120 without the need for significant post-knitting processes or steps. Alternatively, two or more portions of the knitted component 120 may be formed separately as two or more distinct knit components (each of which being integrally knit), and which may be joined following the knitting process.

Forming the upper 110 with the knitted component 120 may provide advantageous characteristics including, but not limited to, a particular degree of elasticity or stretch (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, an interlock structure, a single jersey knit structure, or a double jersey knit structure), by varying the size and tension of the knit structure, by using one or more yarns formed of a particular material (e.g., a polyester material, a relatively inelastic material, or a relatively elastic material such as elastane), by selecting yarns of a particular size (e.g., denier), and/or a combination thereof. The knitted component 120 may also provide desirable aesthetic characteristics by incorporating yarns having different colors, textures or other visual properties arranged in a particular pattern. The yarns themselves and/or the knit structure formed by one or more of the yarns of the knitted component 120 may be varied at different locations such that the knitted component 120 has two or more portions with different properties (e.g., a portion forming the throat area of the upper 110 may be relatively elastic while another portion may be relatively inelastic). In some embodiments, the knitted component 120 may incorporate one or more materials with properties that change in response to a stimulus (e.g., temperature, moisture, electrical current, magnetic field, or light). For example, the knitted component 120 may include yarns formed of at least one thermoplastic polymer material or material composition (e.g., at least one polyurethane, polyamide, polyolefin, and/or nylon) that transitions from a solid state to a softened or liquid state when subjected to certain temperatures at or above its melting point and then transitions back to the solid state when cooled.

As shown in FIG. 3, the knitted component 120 may be knitted in a two-dimensional configuration, which may be subsequently formed into the shape of a wearer's foot through post-knitting methods, e.g., lasting. Or, as shown in FIG. 4, the knitted component 120 may be knitted in a three-dimensional configuration by which the knitting process knits the upper substantially into the shape of a wearer's foot. Such a knitted component 120 may include an opening 240 for receiving a wearer's foot within an overfoot portion 268. The overfoot portion may be joined with an underfoot portion 270 as a result of the knitting process, e.g., around a perimeter 272 of the underfoot portion 270. Such a three-dimensional knitted component 120 may resemble a bootie or a sock following the knitting process. However, it shall be understood that the shapes of the knitted components 120 of FIGS. 2-3 are merely exemplary, as other knitted components embodying the constructions disclosed herein may be knitted in different configurations. For example, the knitted component 120 may be knitted substantially in a two-dimensional U-shape, a C-shape, another one-piece shape with one or more edges in different locations, or a multi-piece configuration. Accordingly, as used herein, the term "knitted component" is not intended to limit said knitted component to a particular shape, manufacturing process, or particular edge configuration.

Referring again to FIG. 3, the knitted component 120 may be divided into a forefoot region 280, a midfoot region 290, and a rearfoot region 300, which may correspond with the forefoot region 150, midfoot region 160, and rearfoot region 170 of article of footwear 100 described above. Likewise, the knitted component 120 may have a lateral part 310 and a medial part 320, which may correspond with the lateral and medial sides 180, 190 of the article of footwear 100 described above. The forefoot, midfoot, and rearfoot regions 280, 290, 300 and lateral and medial parts 310, 320 may not necessarily be defined by the presence of edges or other structures.

Referring still to FIG. 3, the rearfoot region 300 of the knitted component 120 may include a relatively inelastic first zone 330 that may partially surround a relatively elastic second zone 340. The knitted component may optionally include other zones that interact with each other and with other aspects of the knitted component and an article of footwear to secure a wearer's heel, such as a relatively inelastic third zone 350. The first zone 330 may occupy a substantial portion of the lateral part 310 and medial part 320 of the knitted component 120, and may communicate forces to the second zone 340, e.g., via knit stitches, inlaid elements (such as tensile strands), or other structure. To clarify, portions of the first zone 330 may exist in both the lateral and medial parts 310, 320 of the knitted component 120, although the first zone 330 may generally occupy a substantial portion of one or the other of the lateral and medial parts 310, 320. For example, referring to FIG. 7, a portion of the first zone 330 may extend from the medial part 320, around the heel portion 230, and into the lateral part 310. The first zone 330 may be described below in the context of a lateral and/or medial part 310, 320 of the knitted component 120 depending upon a particular illustrated embodiment, but it shall be appreciated that the first zone 330 may substantially exist on either the lateral or medial parts 310, 320, with portions extending into the other of the lateral or medial parts 310, 320. Structural details of the optional third zone 350 may be similarly adaptable.

By comparison with the relatively inelastic first zone 330, the relatively elastic second zone 340 may occupy an area approximately adjacent the first zone 330, and may occupy a calcaneus region 360 of the knitted component 120 that may eventually correspond with a rear portion of a calcaneus bone of a wearer's heel when the knitted component 120 is incorporated into an article of footwear 100. The second zone 340 may further conform to a wearer's heel in use. Such construction of a relatively inelastic first zone 330 and a relatively elastic second zone 340 may differ substantially from conventional knitted components used in footwear applications, which typically feature relatively inelastic and even rigid construction in an area corresponding with a wearer's calcaneus bone, especially the rear of a wearer's calcaneus bone.

The optional third zone 350 may substantially occupy a portion of the knitted component 120 not substantially occupied by the first zone 330, i.e., either the lateral or medial part 310, 320. The third zone 350 may have substantially similar or different placement, design, and construction as the first zone 330, and like the first zone 330, may communicate forces to the second zone 340 via knit stitches or other structure. The precise placement and shape of the first, second, and third zones 330, 340, 350 may vary. Unless stated otherwise, any details described below with respect to the first zone 330 may generally also apply to the third zone 350.

Figure 5:
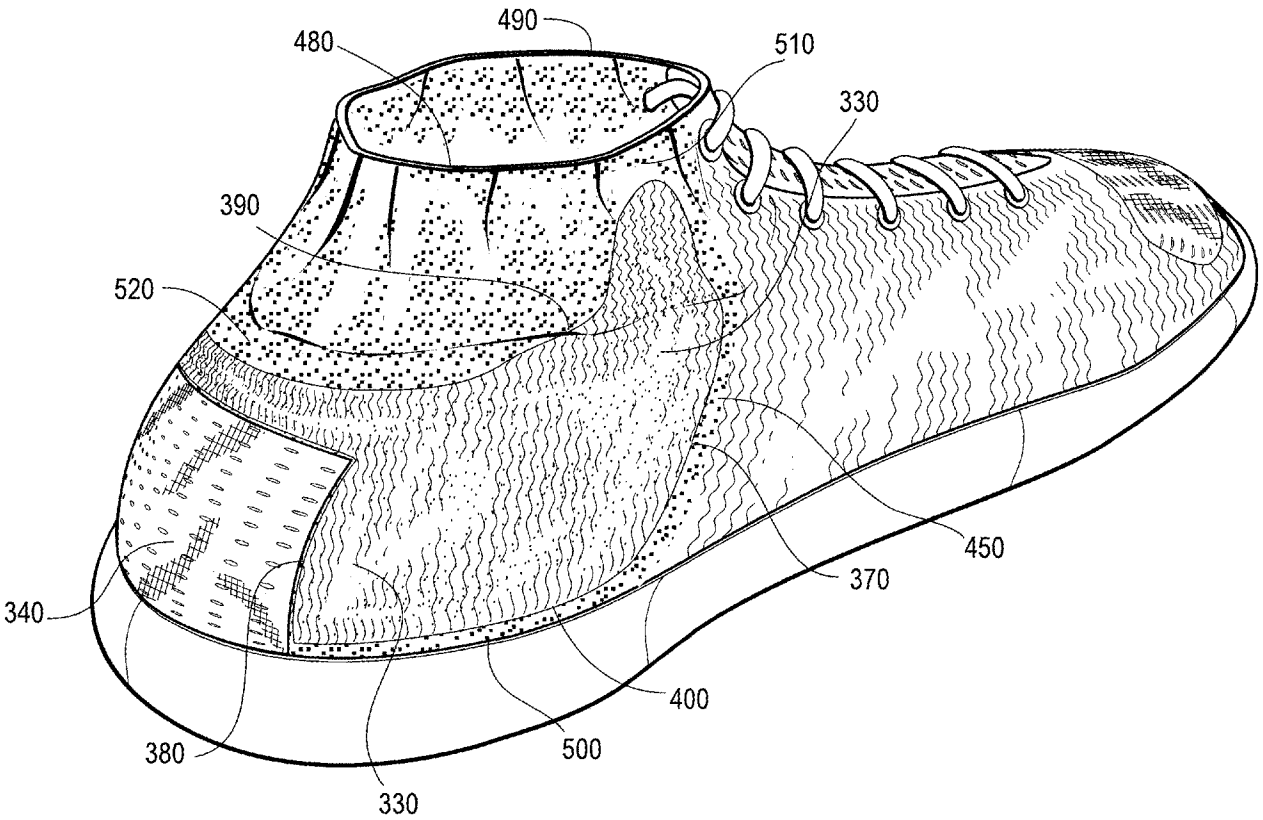
FIG. 5 is an article of footwear incorporating another embodiment of a knit component that may be used to form a knit upper.
Figure 6:
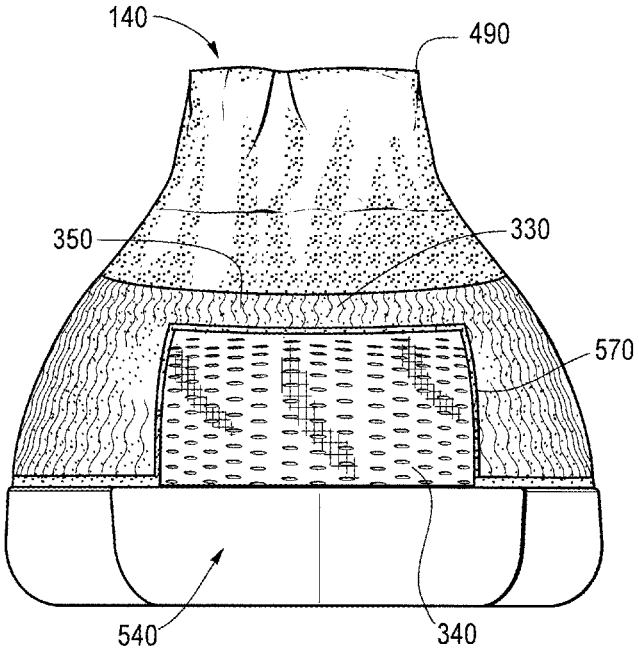
FIG. 6 is a rear view of the article of footwear of FIG. 5.
Figure 7:
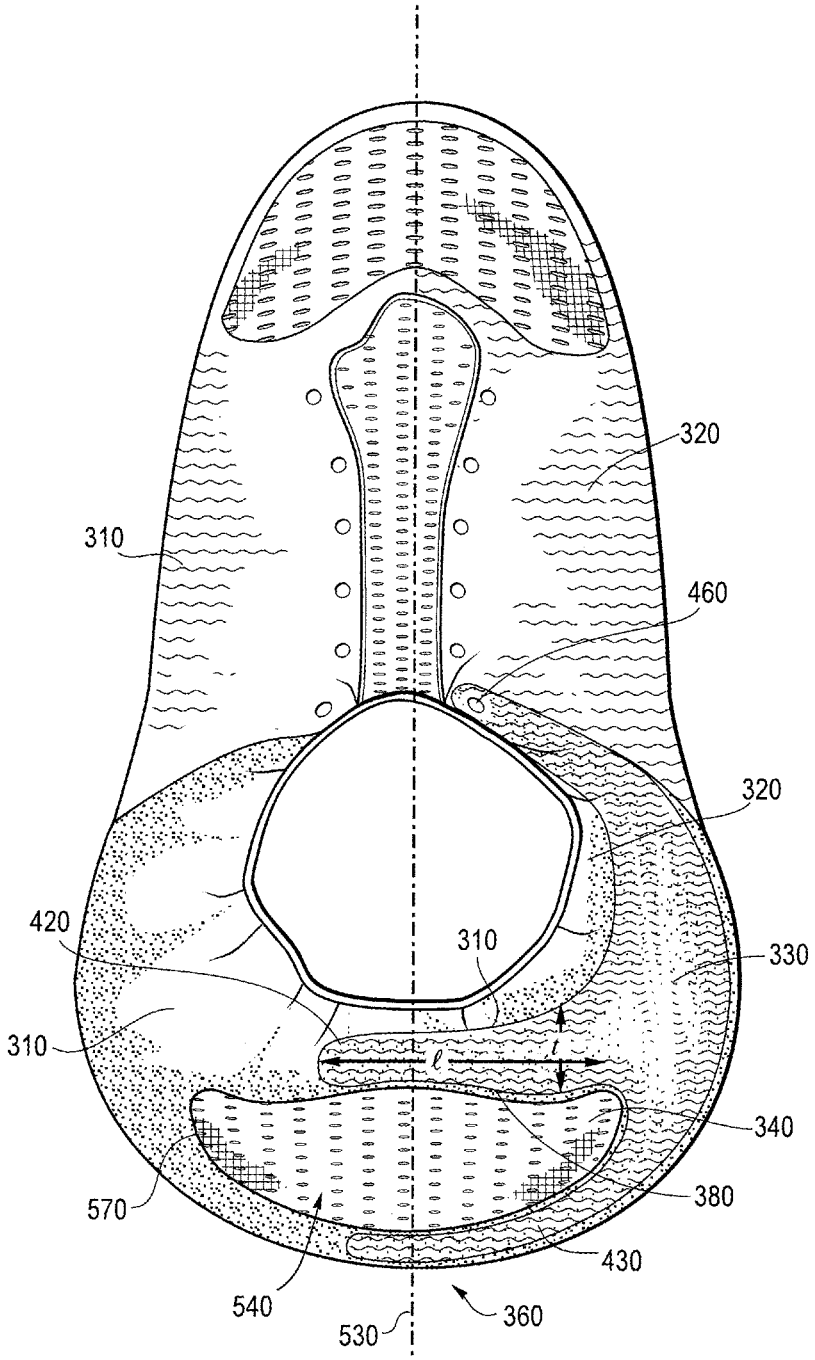
FIG. 7 is another embodiment of a knit component that may be used to form a knit upper.

Referring now to the knitted component 120 of FIG. 4, which may be knitted in three dimensions, the first zone 330 may at least partially surround the second zone 340. The first zone 330 may originate in or near the midfoot or rearfoot regions 290, 300 and may generally have a forefoot boundary 370, a rearfoot boundary 380, and inboard boundary 390 and an outboard boundary 400. The first zone 330 may extend rearward toward a heel region 410, bifurcating into an elongate portion 420 and a lower portion 430. The boundaries of the first zone 330 are not necessarily intended to delineate exact locations, but may generally indicate a transition from the first zone 330 to another portion of the knitted component 120 (such as the second zone 340, third zone 350, or a fourth zone 440), especially if the rearfoot and midfoot portions 300, 290 of the knitted component 120 are knitted integrally as a result of a knitting process. Such a transition may be indicated by physical location only, or by differences between zones such as changes in materials or knit structure. As illustrated in FIG. 5, the forefoot boundary 370 of the first zone 330 may approach a medial border region 450 of the knitted component 120 (which may correspond to the medial border region 210 of the article of footwear 100), though in other embodiments the forefoot boundary 370 may enter or extend through the medial border region 450. The forefoot boundary 370 may also coincide with an aperture 460 (as shown in FIG. 7) or other structure that may eventually form part of a closure system 200 of an article of footwear 100. The rearfoot boundary 380 may generally approach and partially surround the second zone 340. For this reason, the rearfoot boundary 380 may generally have a concave shape (as shown in FIGS. 1-3) or an interior angle (as shown in FIGS. 4-6). The inboard boundary 390 of the first zone 330 may approach or be coterminous with an inboard edge 480 of the knitted component 120, may interface with a collar portion 490, and may have an arcuate shape designed to accommodate the malleoli of a wearer's foot when the knitted component 120 is incorporated into an article of footwear 100. The outboard boundary 400 of the first zone may approach or be coterminous with an outboard edge 500 of the knitted component 120, which may eventually interface with a sole structure 130 and/or a strobel. Alternatively, in the case of a knitted component 120 knitted in three dimensions (as in FIG. 4), the outboard boundary 400 may approach or be coterminous with the underfoot portion 270. Importantly, any of the aforementioned boundaries may have alternative shapes and orientations; for example, referring to FIG. 5, the inboard edge 480 may be substantially linear and oriented from the upper medial side 510 toward the upper heel region 520.

Referring again to FIG. 4, the optional third zone 350 may extend rearward from within the midfoot region 290 to the rearfoot region 300 on the lateral part 310 of the knitted component (i.e, the part not substantially occupied by the first zone 330), and may have characteristics similar to the first zone 330. The first and third zones 330, 350 may have organic shapes, geometric shapes, a combination of both, or other shapes. Portions of the first zone 330 and third zone 350 may not reach a heel region centerline 530; for example, portions of the first zone 330 may terminate in the upper heel region 520 approximately corresponding to an area above a wearer's calcaneus bone and in close proximity to a wearer's Achilles tendon. However, as shown in FIGS. 5-6, portions of the first and third zones 330, 350 may extend all the way to the heel region centerline, and therefore the first zone and the third zone 330, 350 may be continuous with each other, e.g., in the upper heel region 520. It is to be understood that the first zone and third zone 330, 350 may be continuous, yet have different shapes, knit construction, and materials. To clarify, the first zone and the third zone 330, 350 generally occupy separate areas from the second zone (described below), although the first, second, and third zones may be adjacent one another.

Referring now to FIG. 7, the elongate portion 420 of the first zone 330 may have a thickness, t, ranging from approximately 2 mm to approximately 40 mm and a length, l, ranging from approximately 10 mm to approximately 100 mm. The thickness, t, may vary along the length l of the elongate portion 420. The elongate portion 420 may also approach and be coterminous with the inboard and rearfoot boundaries 390, 380 of the first zone 330, and may extend toward and terminate in the upper heel region 520 approximately corresponding to an upper portion of a wearer's calcaneus bone. In various embodiments, the elongate portion 420 may approach, be coterminous with, or extend past the heel centerline 530. In other embodiments, an elongate portion 420 (such as shown in FIGS. 1-2) may have a relatively short length l, approaching the heel centerline and terminating before that point. For comparison, an elongate portion 420 such as shown in FIG. 7 may have a relatively long length l, extending past the heel centerline 530. Intermediate lengths l may also be possible. A longer length l of the elongate portion 420 of the first zone 330 may obviate the need for a third zone 350 of the knitted component. Although the elongate portion 420 may have a tapered shape, it may alternatively have another organic or geometric shape, such as an elliptical shape, a triangular shape, a finger shape, or other elongate shape.

Referring again to FIG. 7, the lower portion 430 of the first zone 330 may extend rearward toward the heel centerline 530, and may generally approach or be coterminous with the rearfoot and outboard boundaries 380, 400 of the first zone. Some embodiments may not have a lower portion 430, especially if such an embodiment has a large second zone 340. For example, FIGS. 5-6 illustrate an article of footwear 100 including a knitted component 120 with a relatively large second zone 340 and without a lower portion of the first zone 330. Returning to FIG. 7, in embodiments having a lower portion 430 of a first zone 330, the lower portion 430 may eventually interface with a sole structure 130. In such cases, a bite line may be adjacent to or be located within the lower portion 430. Similar to the elongate portion 420, the lower portion 430 may have a thickness, t, which may generally range from approximately 2 mm to approximately 70 mm, and a length, l, ranging from approximately 5 mm to approximately 100 mm. The thickness t may generally be small enough so that the lower portion 430 does not significantly occupy an area corresponding to a wearer's calcaneus bone. Like the elongate portion 420, the lower portion 430 may approach, be coterminous with, or extend past the heel centerline 530.

Referring still to FIG. 7, the elongate portion 420 and the lower portion 430 may generally function to transfer a force to the heel region 410 via knit stitches. For example, the elongate portion 420 and the lower portion 430 may experience a tension force, and may pull other aspects of the knitted component 120 toward the forefoot region 280. In particular, the elongate portion 420 may pull the second zone 340 toward the forefoot region 280. Such a tension force may originate from a closure system 200 in an article of footwear 100 (e.g., as shown in FIG. 1), such as a lacing or buckle system. Additionally or alternatively, the tension force may originate from stretching of the materials and/or knit stitches in the knitted component 120 as a result of the insertion of a wearer's foot into an article of footwear 100 incorporating the knitted component 120. To facilitate this force transfer, it may be advantageous to knit at least part of the elongate portion 420 and/or lower portion 430 with knit structures and material(s) that contribute to a relatively low amount of stretch so that a tension force may be effectively transferred via the elongate portion 420 to other aspects of the knitted component 120. For example, knitting courses of the elongate portion 420 with a polyester yarn knitted in a two-needle bed interlock knit stitch may advantageously limit material and mechanical stretch. However, it may also be advantageous to form part of the elongate portion 420 from knit structures and material(s) that exhibit some positive amount of stretch so that a portion of the force transferred to the heel region 410 is not dependent upon a closure system 200, but may originate from the stretching of the first and/or third zones 330, 350. Also, forming the elongate portion 430 from knit structures and material(s) that exhibit some positive stretch may facilitate ingress and egress of a wearer's foot, and may enhance comfort. For example, knitting some courses of the elongate portion 420 with a single jersey knit stitch may permit a desirable limited amount of mechanical stretch.

It may be advantageous to knit the elongate portion 420 and/or the lower portion 430 of the first zone 330 at least partially with a thermoplastic material, and then subsequently form a fused area in that portion by heat treatment. In this description, the term "fused area" generally means an area of the upper where portions of material forming the knitted component 120 (e.g., material initially included with distinct individual yarns of the knitted component 120) are partially or substantially bonded together. A "fused area" is not required to be formed by any specific process. By forming a fused area, the first zone 330 may better transfer forces to the heel region 410. For example, the elongate portion 420 may include courses of yarns formed of at least one thermoplastic polymer material or material composition (e.g., at least one polyurethane, polyamide, polyolefin, and/or nylon) that transitions from a solid state to a softened or liquid state when subjected to certain temperatures at or above its melting point and then transitions back to the solid state when cooled. The one or more thermoplastic polymer materials may provide the ability to heat-process (e.g., heat and then cool) at least a portion of the knitted component to thereby form an area of bonded or continuous material (herein referred to as a "fused area") that exhibits certain advantageous properties, including a relatively high degree of rigidity, strength, and water resistance, for example. In a non-limiting example, two or more separate yarns, including monofilament and/or multifilament yarn, may form a fused area when at least a portion of the material initially included with the yarns is bonded such that at least a portion of the separate yarns become continuous with one another. Further, after bonding to form a fused area, the material of the initially-separate yarns may become visually and/or physically indistinguishable, but this is not the case in all embodiments.

Additionally or alternatively, it may be advantageous to incorporate one or more tensile strands into the first zone 330 or elsewhere in the rearfoot portion 300 to further aid force transfer to the heel region 410. For example, a tensile strand may be inlaid into the first or third zones 330, 350 during the knitting process, and the tensile strand may be anchored elsewhere in the knitted component 120, upper 110, or article of footwear 100. As another example, a tensile strand may be inlaid in a collar portion 490 of the rearfoot region 300, which may extend near the inboard edge 480.

Referring still to FIG. 7, the elongate portion 420 and the lower portion 430 of the first zone 330 (and optionally the third zone 350, in other embodiments) may be integrally knitted with and partially surround the second zone 340, which may stretchably conform to a wearer's heel in use—contrary to conventional construction. That is, the first zone 330 and the second zone 340 may form part of the same knitted component 120 substantially formed from the same knitting process. The second zone 340 may substantially cover a calcaneus region 360 corresponding approximately to the location of a wearer's calcaneus bone. In this application, a second zone 340 may "substantially cover" a calcaneus region 360 if it includes a surface area of at least approximately 4 $cm^2$ positioned within approximately 2 cm of either side of a heel centerline 530. To enable the second zone 340 to conform to a wearer's heel, the second zone 340 may include one or more knit layers having a construction that provides a moderate to high level of stretch, especially as compared to the first and third zones 330, 350. Such stretch may originate from the knit structure itself and/or from the materials used to knit the second zone 340. For example, the second zone 340 may include an interior knit layer that includes courses of yarn knitted in a single jersey knit structure, which offers a relatively high degree of stretch. The second zone 340 may further include a freely separable exterior layer of similar construction formed on a second needle bed. Knitting freely separable layers in the second zone 340 may contribute to reduced friction on a wearer's heel, improved comfort, and a more anatomical fit, although two or more layers may be interconnected and not freely separable. Alternatively, the second zone 340 may include a single knit layer formed on a single needle bed (e.g., in order to reduce weight and improve breathability) or on more than one needle bed (e.g., to improve durability). Furthermore, performance of the second zone 340 may be enhanced if it is at least partially knitted from elasticated yarns. Suitable elasticated yarns may incorporate elastane fiber(s), such as those available from E.I. duPont de Nemours Company under the LYCRA trademark. Such yarns may have the configuration of covered LYCRA, for example yarns having a LYCRA core that is surrounded by a nylon sheath. Other fibers or filaments exhibiting elastic properties may also be utilized. To enhance breathability and stretch, the second zone 340 may include a plurality of apertures 540 (such as knitted apertures), or other structures. To clarify, the second zone 340 may include more than one knit structure or material, for example a different knit structure where the second zone 340 transitions to the first zone 330 or the third zone 350.

The second zone 340 may have a number of shapes that may substantially cover the calcaneus region 360. As shown in FIGS. 1-2, the second zone 340 may have an organic shape. By comparison, FIGS. 3-6 illustrate that the second zone 340 may have a number of geometric shapes. Other shapes are possible and effective for the second zone 340, including other polygonal, conic-sectional, and organic shapes. Regardless of the shape, the second zone 340 may generally be bounded by the elongate portion 420 and (optionally) the lower portion 430 of the first zone 330. In embodiments having a third zone 350, the second zone 340 may be bounded by a third zone elongate portion 550 and third zone lower portion 560.

Referring back to FIGS. 2 and 6, the first zone 330 may at least partially surround the second zone 340, or the first zone 330 and third zone 350 may together partially surround the second zone 340. As used herein, "surrounds" generally refers to the portion of the second zone border 570 that is bounded by the first zone 330 and/or the third zone 350, e.g., expressed as percentage of the second zone border length. Generally, if the first zone 330 bounds at least approximately 10% of the length of the second zone border 570, then then first zone 330 may at least "partially surround" the second zone 340. For example, if the second zone 340 has a border 570 with a 10 cm length, and the first zone 330 borders 4 cm of that length, then the first zone 330 may "partially surround" the second zone 340 because it bounds 40% of the length of the second zone border 570. As another example, if the second zone 340 again has a border length of 10 cm, and each of the first and third zones 330, 350 bound 0.5 cm of the second zone border 570, then the first and third zones 330, 350 may together "partially surround" the second zone 340, although neither the first zone 330 nor third zone 350 may individually "partially surround" the second zone 340. To clarify, in order for a portion of the first and/or third zones 330, 350 to "bound" the second zone, that portion should generally lie within 2 cm of the second zone 340, but may lie within a smaller distance, e.g., 1 cm.

Figure 8:
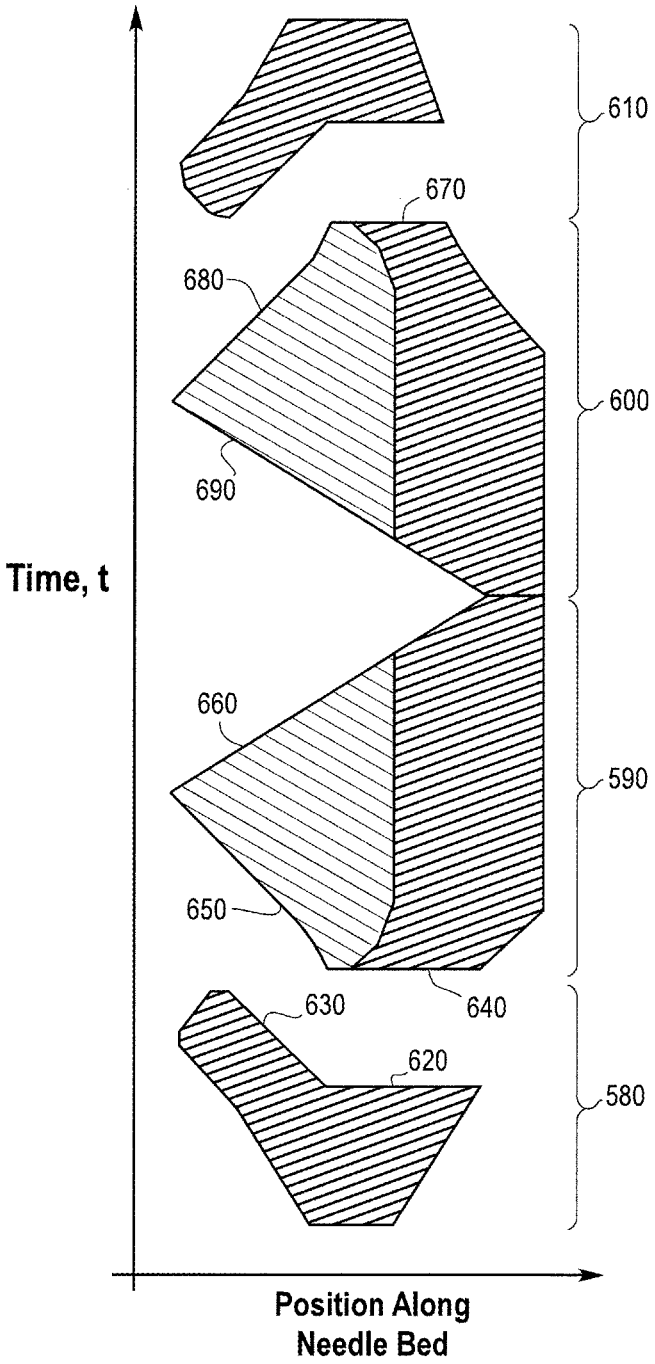
FIG. 8 schematically illustrates of an exemplary method of knitting a knit component.
Figure 9:
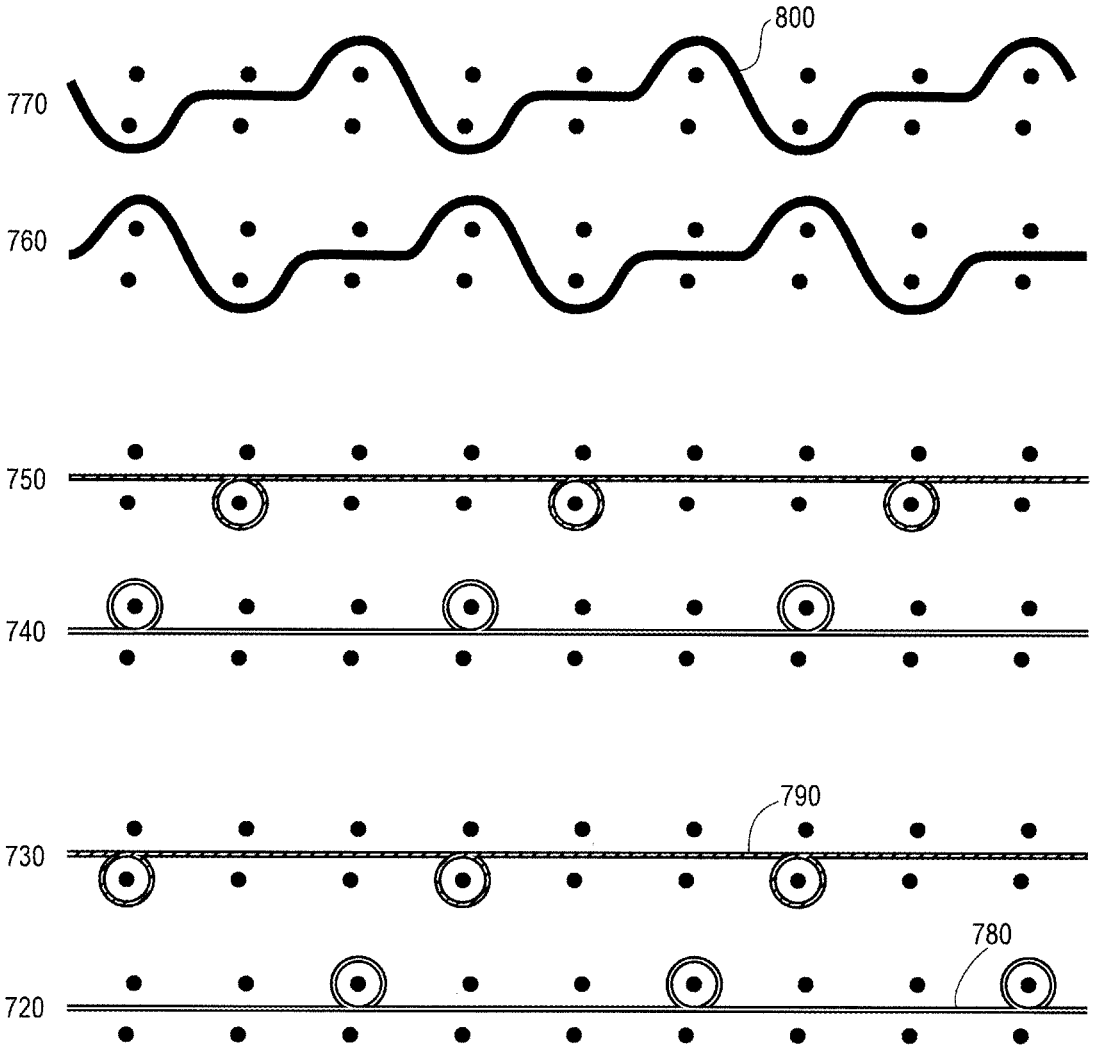
FIG. 9 is a knitting diagram illustrating an exemplary method of knitting a first zone of a knit component.
Figure 10:
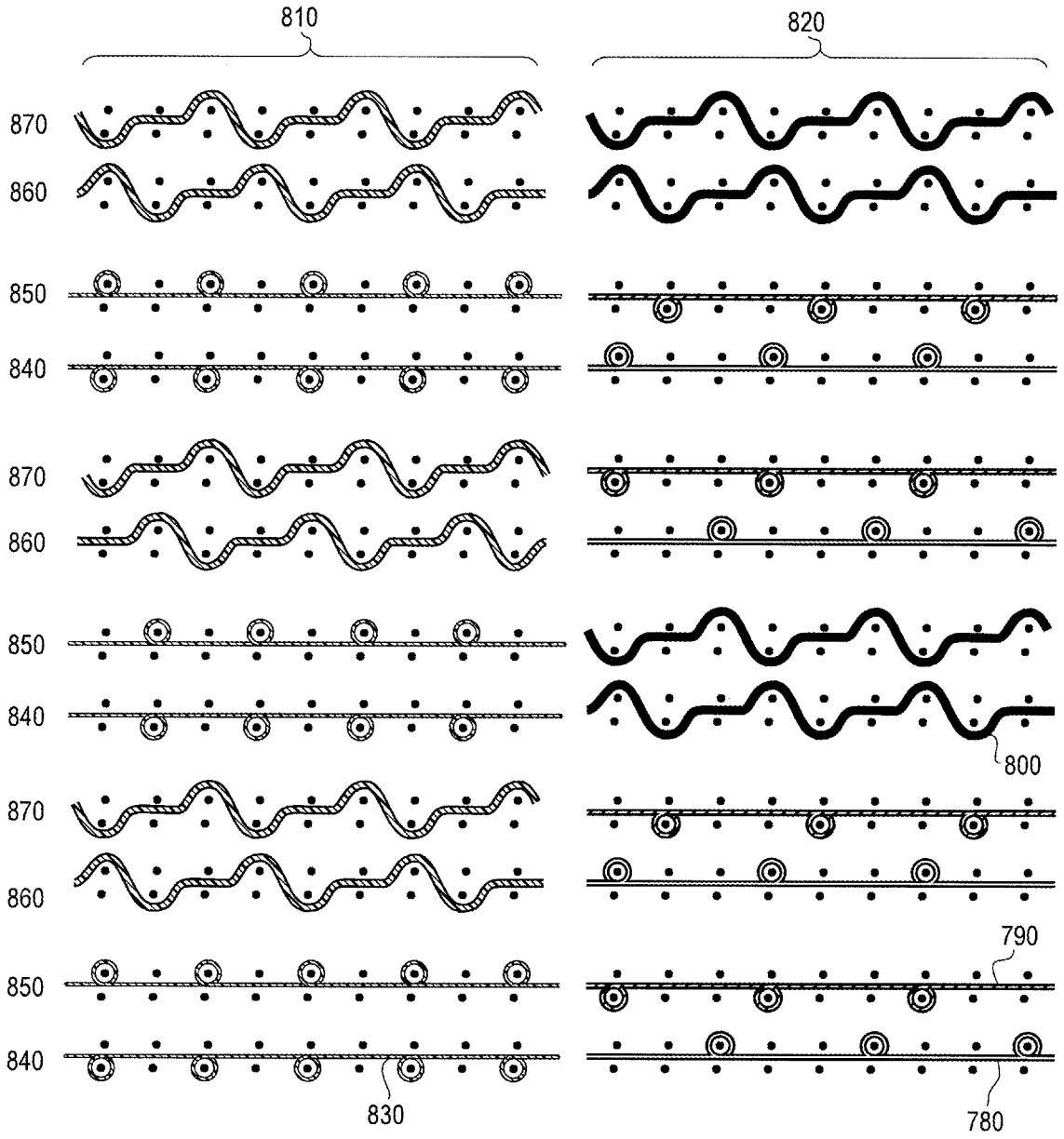
FIG. 10 is a knitting diagram illustrating an exemplary method of knitting a first zone and a second zone of a knit component.

Referring to FIG. 4 in combination with FIGS. 8-10, FIGS. 8-10 schematically illustrate a method of forming a knitted component 120 having a first zone 330 and a third zone 350, each having elongate portion 420, 550 and each having a lower portion 430, 560, and where one or both of the first and third zones 330, 350 at least partially surrounds a second zone 340 that substantially covers a calcaneus region 360. Referring to FIG. 8, a process diagram includes a y-axis corresponding with knitting time, and an x-axis corresponds with a position along one or more needle beds, for example a first needle bed and a second needle bed on a weft knitting machine. The process diagram illustrates the temporal order in which a knitting machine may knit a first region 580, a second region 590, a third region 600, and a fourth region 610 of an integrally-knit knitted component 120. To clarify, the first-fourth regions 580-610 may be integrally knit as a one-piece knitted element 120 formed from a single knitting process, without any post-processing steps necessary to join the first-fourth regions 580-610. Any of the regions may include more than one knit structure and more than one yarn or strand type, as illustrated in the knit diagrams of FIGS. 9-10.

Referring to FIG. 8, at a first step, the knitting machine may knit the first region 580, which may correspond with a first part of a first zone 530 as described above (such as a first zone 530 on a medial part 320 of a knitted component 120), including an elongate portion 420. The first region 580 may include a first edge 620 and a second edge 630, which may later be integrally knitted with corresponding first and second edges of the second region 590. After the knitting machine substantially completes knitting the first region 580, in particular the elongate portion 420, one or more transition yarn feeders may knit a series of transition courses to prepare the knitting machine to knit the second region 590. By knitting substantially the entire elongate portion 420 prior to knitting the second region 590, the knitting machine may avoid crossing yarns of the relatively inelastic first zone 330 with yarns of the relatively elastic second zone 340.

At a second step, the knitting machine may knit the second region 590, which may correspond with a second part of the first zone (such as a lower portion 430 of the first zone 330) and may also correspond with a first part of a second zone (such as a medial part of a second zone 340 that substantially covers a calcaneus region 360). The second region 590 may include a first edge 640, a second edge 650, and a third edge 660. The first and second edges 640, 650 may be integrally knit with corresponding edges of the first region 580. The third edge 660 may later correspond with a heel centerline 530. Within the second region 590, the knitting machine may knit different knit structures and with different materials as it transitions from knitting the first and second zones 330, 350. Following the second step 590, the first zone 330 may be substantially complete, the second zone 340 may be partially complete, and the first zone 330 may at least partially surround the second zone 340.

At a third step, the knitting machine may knit a third region 600, which may correspond with a second part of the second zone (such as a lateral part of the second zone 340 that substantially covers the calcaneus region 360) and may also correspond with a first part of a third zone (such as a lower portion 560 of a third zone 350 on a lateral part 310 of the knitted component 120). In the third region 600, the knitting machine may knit different knit structures and with different materials as it transitions from knitting the second and third zones 340, 350. Like the second region, the third region may include a first edge 670, a second edge 680, and a third edge 690. The first and second edges 670, 680 of the third region 600 may later be integrally knit with corresponding edges of the fourth region 610. The third edge 690 may later correspond with a heel centerline in an article of footwear 100 and may be knitted integrally with the corresponding third edge 660 of the second region 590. Notably, as a result of integrally knitting the third edges 660, 690 of the second and third regions 590, 600, the resulting knitted second zone 340 may contain courses having at least two angular orientations. After the knitting machine substantially completes knitting the third region 600, one or more transition yarn feeders may knit a series of transition courses to prepare the knitting machine to knit the fourth region 610, so that yarns of the third region 600 may not cross with yarns of the fourth region 610 (in particular, yarns of the relatively elastic second zone 340 knitted during the third step may not cross with yarns of the relatively inelastic elongate portion 550 of the third zone 350 to be knitted in the fourth step). Following the third step, the second zone 340 may be substantially complete, and the third zone 350 may be partially complete.

At a fourth step, the knitting machine may knit the fourth region 610, which may correspond with a second part of a third zone, namely an elongate portion 550 of the third zone 350. The fourth region 610 may have a first edge 700 and a second edge 710 that are integrally knit with corresponding edges of the third region 600. By knitting substantially the entire elongate portion 550 after knitting the third region 600, the knitting machine may avoid crossing yarns of the third region 600 with yarns of the fourth region 610 (again, the process may avoid crossing yarns of the relatively elastic second zone 340 with relatively inelastic yarns of the elongate portion 550 of the third zone 350).

After completion of the first through fourth steps, the knitting machine may have knitted at least part of a rearfoot region 300 of a knitted component 120 including a first zone 330 having an elongate portion 420, a second zone 340 that substantially covers a calcaneus region 360, and a third zone 350 also having an elongate portion 550, where one or both of the first zone and the third zone 330, 350 at least partially surround the second zone 340.

FIG. 9 illustrates knit structures that may be utilized to knit the first region 580 and the fourth region 610 of FIG. 8.

In particular, the knit structures may correspond with part of a first zone 330 or a third zone 350, in particular an elongate portion 420, 550 where limited stretch may be desirable. In a first course 720 and a third course 740, a first yarn type 780 may be knitted in a partial gauge stitch density (e.g., one-third gauge) on a single needle bed (e.g., on a rear needle bed of a two-needle weft knitting machine). In a second course 730 and a fourth course 750, a second yarn type 790 may also be knitted in a partial gauge stitch density, but on another needle bed from the first and third courses 720, 740 (e.g., on a front needle bed). In a fifth and sixth course 760, 770, a third yarn type 800 (which may be the same as either the first or the second yarn types 780, 790) may be tucked or looped on needles of the needles beds utilized during the first through fourth courses 720-750, thereby joining fabric layers formed on different needle beds in the first through fourth courses 720-750. First through sixth courses 720-770 may be repeated in order until the target knitting height is achieved, and the first and second yarns 780, 790 may be selected for relatively low stretch. As one example, the first yarn type 780 may be a fusible thermoplastic polymer yarn that may undergo a post-knitting heat treatment to form a fused zone to impart strength and stretch resistance to the first or third zone 330, 350. As another example, the second yarn type 790 may be a polyester yarn having relatively low elasticity (e.g., as measured by Young's modulus), and relatively high durability. Other yarn types are possible for the first and second yarn types 780, 790, including nylon yarns (which may also offer relatively high durability), and/or yarn types offering a relatively soft hand (which may be utilized to form courses that may eventually contact a wearer's foot). The resulting structure may offer a relatively low degree of stretch due to the selection of relatively inelastic yarns (especially following heat treatment); however, additional or alternative knit structures or materials may be selected to tailor performance of the first and/or third zone(s) 330, 350. For example utilizing a double bed structure (e.g., interlock) may further limit stretch and enhance performance.

FIG. 10 illustrates knit structures that may be utilized to knit the second and third regions 590, 600 of FIG. 8. In particular, FIG. 10 is bifurcated into a first knit structure 810 and a second knit structure 820. The first knit structure 810 may correspond with part of the relatively elastic second zone 340, and the second knit structure 820 may correspond with a lower part 430, 560 of a relatively inelastic first zone or third zone 330, 350.

The first knit structure 810 may include a series of courses of a fourth yarn type 830, which may be an elasticated yarn having relatively high stretch. In a first course 840, the fourth yarn type 830 may have a single jersey construction knitted in a partial gauge stitch density (e.g., half gauge) on a first needle bed. In a second course 850, the fourth yarn type 830 may have substantially similar construction as the first course 840, but knitted on a second needle bed. In a third and fourth course 860, 870, the fourth yarn type 830 may be tucked on needles utilized during the first and second courses 840, 850, thereby joining those fabric layers. The resulting first knit structure may offer a relatively high degree of stretch due to the selection of elasticated yarns; however, additional or alternative knit structures or materials may be selected to tailor performance of the second zone 340. For example, the second zone 340 may include knitted a plurality of apertures 460 formed by transferring stitches of the first and second courses 840, 850 to needles on another needle bed. Such a plurality of apertures 460 may enhance breathability of the second zone 340 and provide an appealing aesthetic. The second knit structure 820 of FIG. 10 may be similar to the knit structure illustrated in FIG. 9, given that it may correspond to other portions of the first zone and/or third zone(s) 330, 350 knitted in the first and fourth regions 580, 610 of FIG. 8.

Referring back to FIG. 1, in use, a wearer may insert a foot into the void 140 of an article of footwear 100 incorporating a knitted component 120 with a self supportive heel structure having a first zone 330 at least partially surrounding a second zone 340 that substantially covers a calcaneus region 360. By inserting a foot into the void 140, the wearer may cause yarns and/or strands in the first zone 330 to stretch and experience a tension force. Additionally, if a wearer engages a closure system 200 (such as the lacing system shown), that action may further increase the tension force in the first zone 330. Given that the first zone 330 and the second zone 340 form part of the same integrally-knit knitted component 120, the tension force may cause the first zone 330 to generally pull the second zone 340 forward towards the forefoot region 150, thereby causing the relatively elastic second zone 340 to conform to the wearer's heel. This anatomical conformance helps secure the wearer's foot in the article of footwear 100 during ambulatory activities such as walking, running, and athletics. Furthermore, the first and second zones 330, 340 may provide such an advantageous fit without the cost and weight of additional components, such as a heel counter or other rigid structure. This is especially beneficial because traditional heel counters may reduce flexibility and may cause undesirable rubbing and irritation. Eliminating such structure from an article of footwear may further reduce weight and increase manufacturing costs. Thus, a knitted component constructed and manufactured as disclosed above may offer a number of advantages over traditional footwear construction.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A knitted component for an article of footwear, the knitted component comprising:

a medial part and a lateral part;

a forefoot region; a midfoot region; and, a rearfoot region having a heel region centerline located between the medial part and the lateral part, the rearfoot region comprising:

a first zone having a first level of stretch and extending from a lower region of one of the medial part or the lateral part within the rearfoot region toward an upper heel region within the rearfoot region, the first zone having an inelastic elongate portion comprising a first extension and a second extension; and a second zone adjacent to the first zone, wherein the second zone has a greater elasticity than the first zone, the second zone extending partially into the medial part, across the heel region centerline, and partially into the lateral part in the rearfoot region, and positioned to substantially cover a calcaneus region of the knitted component, the second zone having a superior side and an inferior side, the superior side being closer, compared to the inferior side, to a foot-receiving opening of the article of footwear, wherein the inelastic elongate portion of the first zone is integrally knitted with the second zone such that the first extension extends at least partially over the superior side of the second zone and the second extension extends at least partially under the inferior side of the second zone, such that the inelastic elongate portion of the first zone at least partially surrounds the second zone in the calcaneus region, wherein the first zone separates the second zone from a collar portion, and wherein the second zone is separate from the collar portion.

2. The knitted component of claim 1, further comprising a third zone extending from a lower region of the other of the medial part or the lateral part toward the upper heel region, the third zone having an elongate portion.

3. The knitted component of claim 1, wherein the first zone comprises a thermoplastic yarn.

4. The knitted component of claim 1, wherein the second zone has a different knit stitch than the first zone.

5. The knitted component of claim 1, wherein the first zone comprises a double bed knit structure.

6. The knitted component of claim 1, wherein the knitted component comprises an overfoot portion joined with an underfoot portion around a perimeter.

7. The knitted component of claim 1, wherein the inelastic elongate portion of the first zone comprises at least one of an elliptical shape, a rectangular shape, a triangular shape, a finger shape, and a tapered shape.

8. The knitted component of claim 2, wherein the first zone is continuous with the third zone in the upper heel region.

9. The knitted component of claim 1, wherein the first zone bounds at least half of a border length of the second zone.

10. An article of footwear, comprising:

an upper having a medial side and a lateral side, the upper comprising a forefoot region, a midfoot region, and a rearfoot region, the rearfoot region having a heel region centerline located between the medial side and the lateral side, the rearfoot region comprising:

a knitted component comprising:

a first zone extending from a lower region of one of the medial side or the lateral side toward an upper heel region, the first zone having an inelastic elongate portion comprising a first extension and a second extension; and a second zone comprising a greater elasticity than the first zone, the second zone extending from the medial side, across the heel region centerline, and to the lateral side, and positioned to substantially cover a calcaneus region of the knitted component, the second zone having a superior side and an inferior side, the superior side being closer, compared to the inferior side, to a foot-receiving opening of the article of footwear, wherein the inelastic elongate portion of the first zone is integrally knitted with the second zone such that the first extension extends at least partially over the superior side of the second zone and the second extension extends at least partially under the inferior side of the second zone, such that the inelastic elongate portion at least partially surrounds the second zone in the calcaneus region, wherein the second zone comprises a boundary defining an entire perimeter of the second zone and wherein the first zone entirely separates the second zone from a collar portion, and wherein the second zone is separate from the collar portion.

11. The article of footwear of claim 10, further comprising a third zone having an elongate portion extending from a lower region of the other of the medial side or the lateral side of the upper toward the upper heel region.

12. The article of footwear of claim 10, wherein the rearfoot region does not include a heel counter.

13. The article of footwear of claim 11, wherein the first zone and the third zone are continuous in the upper heel region.

14. The article of footwear of claim 10, wherein the inelastic elongate portion of the first zone experiences a tension force that pulls the second zone forward toward the forefoot region.

15. The article of footwear of claim 10, wherein the first zone forms a connection with a closure system.

16. The article of footwear of claim 15, wherein the closure system comprises a tensile strand in a collar region.

17. The article of footwear of claim 15, wherein the closure system is configured to create a tension force in the first zone.

18. The knitted component of claim 1, wherein the second zone comprises at least one of:

a closed shape, and an amorphous shape.

19. An article of footwear, comprising:

an upper having a medial side and a lateral side, the upper comprising a forefoot region, a midfoot region, and a rearfoot region, the rearfoot region having a heel region centerline located between the medial side and the lateral side, the rearfoot region comprising:

a knitted component comprising:

a first zone extending from a lower region of one of the medial side or the lateral side toward an upper heel region, the first zone having an inelastic elongate portion comprising a first extension and a second extension; and a second zone comprising a greater elasticity than the first zone, the second zone extending from the medial side, across the heel region centerline, and to the lateral side, and positioned to substantially cover a calcaneus region of the upper, the second zone having a superior side and an inferior side, the superior side being closer, compared to the inferior side, to a foot-receiving opening of the article of footwear, wherein the inelastic elongate portion of the first zone is integrally knitted with the second zone such that the first extension extends at least partially over the superior side of the second zone and the second extension extends at least partially under the inferior side of the second zone, such that the inelastic elongate portion at least partially surrounds the second zone in the calcaneus region of the upper, wherein the first zone entirely separates the second zone from a collar portion, and wherein the second zone is separate from the collar portion.

* * * * *